US008479324B2

(12) United States Patent
Chen et al.

(10) Patent No.: US 8,479,324 B2
(45) Date of Patent: Jul. 9, 2013

(54) CONDUCTIVITY SENSOR AND URINAL WITH CONDUCTIVITY SENSOR

(75) Inventors: Zhongmin Chen, Shanghai (CN); Pengcheng Gao, Shanghai (CN); Lin Wang, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 769 days.

(21) Appl. No.: 12/619,841

(22) Filed: Nov. 17, 2009

(65) Prior Publication Data

US 2010/0125937 A1 May 27, 2010

(30) Foreign Application Priority Data

Nov. 24, 2008 (CN) ..... 2008 1 0203263

(51) Int. Cl.
*E03D 13/00* (2006.01)

(52) U.S. Cl.
USPC ..... 4/305

(58) Field of Classification Search
USPC ..... 4/302, 303, 304, 305
See application file for complete search history.

(56) References Cited

U.S. PATENT DOCUMENTS 669,037 A * 2/1901 Stevens ..... 4/305
3,751,736 A * 8/1973 Egli ..... 4/305
3,855,101 A * 12/1974 Wilson ..... 204/406

* cited by examiner

*Primary Examiner* — Huyen Le
(74) *Attorney, Agent, or Firm* — Foley & Lardner LLP

(57) ABSTRACT

The present invention discloses a urinal with a conductivity sensor, which includes the conductivity sensor arranged at the location where a reservoir of the urinal is curved and adapted to detect urine, a control unit (MCU), a power battery, and an electromagnetic valve adapted to control a discharge of water, wherein the conductivity sensor is adapted to detect a conductivity to determine whether urine is present. After the conductivity sensor detects presence of urine, the control unit opens the electromagnetic valve. The conductivity sensor includes electrodes dipped inside the location where the reservoir is curved to contact urine. The conductivity sensor further includes an anti-polarization-of-electrode circuit based upon the principle of an alternating power supply. Thus, the sensor can achieve more reliable sensing and a longer lifetime.

8 Claims, 3 Drawing Sheets

CONDUCTIVITY SENSOR AND URINAL WITH CONDUCTIVITY SENSOR

FIELD OF THE INVENTION

The present invention relates to a conductivity sensor and a urinal with the conductivity sensor in the field of a bathroom.

BACKGROUND OF THE INVENTION

In the prior art, a sensor for detecting a human body, e.g., an infrared sensor, etc., is traditionally stalled on a urinal to automate a task of rinsing the body of the urinal after usage thereof. Thus, a sensing window required to be exposed from the traditional infrared sensor may make against appearance and maintenance and also suffer from the following drawbacks.

On one hand, the traditional infrared sensor mainly adopts an active infrared sensing approach, that is, an infrared transmitter transmits infrared light at a wavelength, which is reflected by the human body and then received by an infrared receiver to determine the strength of the reflected signal, thereby achieving automatic sensing and determination. However, it may be rather difficult to achieve automatic sensing and determination for some substances with a low reflectivity in respect of infrared light (e.g., black clothing, hair, etc.). Only a small portion of infrared light from the infrared transmitter reflected by such substances can be received by the infrared receiver. The sensor can not determine whether there is a target object due to the insufficient strength of the reflected signal, which may result in a malfunction.

On the other hand, an amount of rinsing water will be discharged to rinse the urinal when the traditional infrared sensor detects again that a user goes away after a period of time since the user is detected. However, such a system for automatic rinsing dependent upon detection of presence or absence of the human body will discharge the amount of rinsing water regardless of whether it has been used by the user or of the amount of his urine, which may result in a considerable waste of water.

In the prior art, a conductivity sensor has been used to detect a variation of the conductivity of water at the location where a reservoir of a urinal is curved. Due to the difference between the conductivities of urine and tap water, an electrode of the conductivity sensor comes into contact with urine, if any, to detect a variation of the conductivity, so that an inflow of urine can be determined to thereby control rinsing of the urinal. The conductivity sensor addresses the drawbacks of the traditional infrared sensor that the sensing window has to be required and that it may fail to sense a substance with a low reflectivity.

Since a bathroom appliance, e.g., a urinal, etc., is typically powered by direct current (that is, powered by a battery), the phenomenon of polarization tends to occur with the electrode of the conductivity sensor. The so-called polarization refers to the departure of a potential of the electrode from its equilibrium value when (net) current flows therethrough, which is called polarization. The phenomenon that a potential of the electrode departs from an equilibrium potential of the electrode when current passes therethrough is referred to as polarization of the electrode. Thus, polarization of electrodes tends to cause inaccuracy of a conductivity detected between the electrodes, so that an actual condition may not be reflected properly, which may ultimately result in the problems of a degraded conductivity, a failure of sensing, etc.

Furthermore, a user may stand for a long period of time due to his prostatitis or another reason, so that the urinal arranged with the conductivity sensor will be rinsed in the case that the user has not gone away. This situation may discomfort the user on one hand and cause false determination of a failure of sensing of the urinal on the other hand. Still furthermore, a period of rinsing for the conductivity sensor has to be manually set, but the amount of rinsing water can not be determined dependent upon that of urine.

How to develop a more reliable conductivity sensor or a sensing device for a urinal using the same has become a common focus of attention in the industry.

Moreover, the conductivity sensor which has been widely applied in the field of a bathroom can be applied in other aspects than the sensing device for a urinal as described above, e.g., a water level detection device for a bathtub. The problem of polarization, a degraded conductivity or a failure of an electrode may also occur with the conductivity sensor, for example, applied as a water level detection device for a bathtub. Therefore, a more reliable conductivity sensor has also become a common focus of attention in the industry.

SUMMARY OF THE INVENTION

An object of the invention is to provide a reliable conductivity sensor and a urinal with the conductivity sensor.

The object of the invention can be attained by the following technical solution. A conductivity sensor is arranged in a bathroom appliance and includes electrodes dipped into the bathroom appliance and adapted to detect the conductivity of solution, wherein the electrodes include positive and negative electrodes. The conductivity sensor further includes an anti-polarization-of-electrode circuit.

Furthermore, the anti-polarization-of-electrode circuit includes two sets of double throw switches adapted to toggle the polarities of the electrodes to thereby provide the electrodes with an alternating power supply.

The object of the invention can further be attained by the following technical solution. A urinal with a conductivity sensor includes the conductivity sensor arranged at the location where a reservoir of the urinal is curved and adapted to detect urine, a control unit (MCU), a power battery, and an electromagnetic valve adapted to control a discharge of water, wherein the conductivity sensor is adapted to detect a conductivity to determine whether urine is present. After the conductivity sensor detects presence of urine, the control unit opens the electromagnetic valve. The conductivity sensor includes electrodes dipped inside the location where the reservoir is curved to contact urine. The conductivity sensor further includes an anti-polarization-of-electrode circuit.

Furthermore, the electrodes include positive and negative electrodes

Furthermore, the anti-polarization-of-electrode circuit includes two sets of double throw switches adapted to toggle the polarities of the electrodes to achieve an alternating power supply Furthermore, a conductivity threshold is preset so that presence of urine is determined when the conductivity is larger than the conductivity threshold.

Furthermore, the concentration of urine is calculated from the conductivity and converted into the amount of rinsing water.

Furthermore, a functional relationship between the concentration of urine and the conductivity is $A=aL^2+bL$, wherein A is the concentration of urine, L is the conductivity, and a and b are coefficients.

Furthermore, the conductivity sensor instructs the control unit to open the electromagnetic valve upon detection of the equilibrium of the conductivity of urine.

Furthermore, a constant conductivity is preset so that the equilibrium is determined if variations between the conductivities of urine sampled at consecutive three points are smaller than the constant conductivity.

Furthermore, a detection frequency for the conductivity sensor in the status that urine is absent is lower than that in the status that urine is present to save electric power.

Furthermore, the conductivity sensor is capable of self-learning.

As compared with the prior art, the conductivity sensor and the urinal with the conductivity sensor according to the present invention can be anti-polarization-of-electrode to thereby achieve a reliable sensing effect and a longer lifetime.

DETAILED DESCRIPTION OF THE INVENTION

Figure 1:
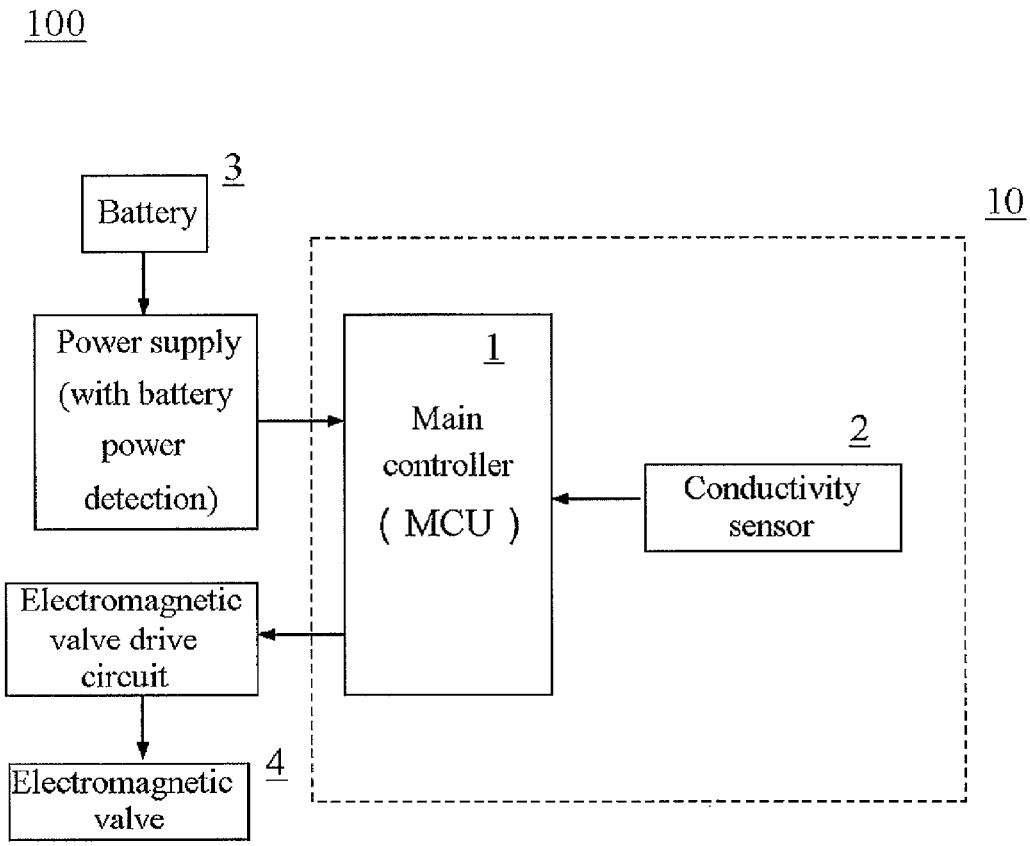
FIG. 1 is a schematic diagram illustrating the structure of a conductivity sensor and a urinal with the conductivity sensor according to an embodiment of the invention.

Various embodiments of the invention will be set forth in details below with reference to the drawings in which the same components or functions are denoted with the same reference numerals. It shall be noted that the drawings are merely intended to facilitate descriptions of the embodiments of the invention but not as redundant descriptions or to limit the scope of the invention. Moreover, the drawings have not been necessarily drawn to scale.

As illustrated in FIG. 1, a conductivity sensor 10 according to an embodiment of the invention includes a control unit (MCU) 1 and a conductivity sensor 2 for detecting urine. And, a urinal 100 with the conductivity sensor according to an embodiment of the invention further includes a power battery 3 and an electromagnetic valve 4 in addition to the conductivity sensor 10.

The conductivity sensor 10 according to an embodiment of the invention is powered by the battery 3, and an electromagnetic valve drive circuit is controlled by the control unit 1 to drive the electromagnetic valve 4 to be opened and closed, thereby controlling a discharge of water for the urinal. Specifically, an electrode of the conductivity sensor 2 detects urine and notifies the control unit 1 about a detection result through a conductivity detection circuit. Upon determination of presence of urine, the control unit 1 further controls the electromagnetic valve 4 to be opened and closed through the electromagnetic valve control circuit, thereby controlling a discharge of water for the urinal 100 or another urinal The power supply circuit of the urinal 100 according to an embodiment of the invention further includes a battery power supply detection circuit. When a voltage of the battery is below a specific value, the battery can be determined to be drained soon, and a notice of replacement thereof can be given, for example, with a periodical brief beep, a lasting beep, etc.

Figure 2:
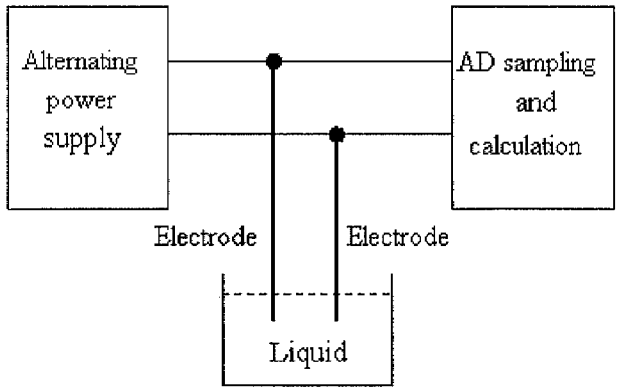
FIG. 2 is a schematic diagram illustrating the structure of the conductivity sensor according to an embodiment of the invention.

As illustrated in FIG. 2, there are positive and negative detection electrodes of the conductivity sensor 2, which are dipped below the surface of detected liquid. The system can determine whether to rinse by sensing the concentration of urine dependent upon the difference between conductivities of pure tap water and urine.

Moreover, the conductivity sensor 2 can detect and convert the conductivity of urine into the concentration of urine by a relationship between the conductivity of urine and the concentration thereof, thereby calculating the amount of rinsing water. Thus, the amount of rinsing water can be determined intelligently from the amount of urine. Specifically, the higher the concentration of urine is, the larger the conductivity thereof will be, which is expressed approximately by a fundamental principle equation $A=aL^2+bL$, where A is the concentration of urine, L is the conductivity thereof, and a and b are coefficients. At the end of rinsing, the conductivity sensor 2 can further detect the concentration to thereby monitor an effect of rinsing. Therefore, the conductivity sensor 2 according to an embodiment of the invention can distinguish the proportion of urine in water to thereby determine the amount of rinsing water from the concentration of urine, and further detect the concentration of the liquid mixture after rinsing, to thereby achieve a closed loop control on the amount of rinsing water. A specific relationship between the concentration of urine and the amount of rinsing water can be determined experimentally and dependent upon a specific structure of the urinal. Thus, more intelligent sensing can be achieved, and saving of water can be facilitated.

The conductivity sensor 2 is further arranged with an anti-polarization-of-electrode circuit (i.e., an alternating power supply-enabled circuit). Since a bathroom appliance, e.g., a urinal, etc., is typically powered by direct current (that is, powered by a battery), the phenomenon of polarization tends to occur with the electrode of the conductivity sensor 2. The so-called polarization refers to the departure of a potential of the electrode from its equilibrium value when (net) current flows therethrough. The phenomenon that a potential of the electrode departs from an equilibrium potential of the electrode when current passes therethrough is referred to as polarization of the electrode. Therefore, polarization of the electrodes tends to cause inaccuracy of a conductivity detected between the electrodes, so that an actual condition may not be reflected properly, which may ultimately result in the problems of a degraded conductivity, a failure of sensing, etc. As illustrated in FIG. 2, a fundamental electrical principle feature of the circuit of the conductivity sensor 2 according to an embodiment of the invention lies in anti-polarization-of-electrode by means of an alternating power supply. Further referring to FIG. 3, S is a double thrown switch for toggling the polarity of the electrode, R is a resistor, an MCU is the control unit, and A is a voltage sample point. Two sets of double thrown switches are used to toggle the polarities of the electrodes to thereby achieve an anti-polarization-of-electrode function, where analog switches can be used as the toggling switches.

Figure 3:
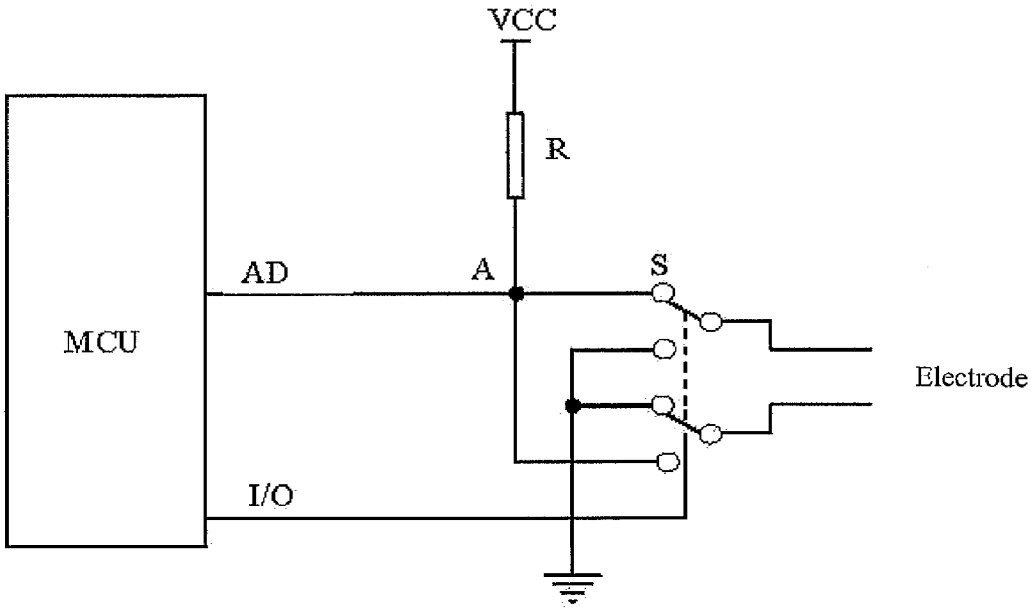
FIG. 3 is a circuit diagram illustrating an alternating power supply of the conductivity sensor according to an embodiment of the invention.

Referring to FIG. 3 again, the control unit 1 samples a voltage at the point A of the electrodes (actually a voltage between the electrodes) and calculates the conductivity of liquid through analog-to-digital conversion, thereby deriving the concentration of urine. It shall be noted that FIG. 3 illustrates only a preferred embodiment of the invention and the voltage of the electrodes can be sampled differently. A relationship between the voltage sampled at the point A and the conductivity shall be determined dependent upon a specific circuit design, and there will be more than one possible calculation equation. In brief, the lower the voltage sampled at the point A is, the larger the conductivity will be; on the contrary, the higher the voltage sampled at the point A is, the smaller the conductivity will be.

The conductivity sensor 2 is installed at the location where a siphon is curved below the body of the urinal (not shown), preferably at a position where rapid sensing of urine can be facilitated and where the surface of the electrode is not susceptible to a contamination deposit. The installed electrodes shall be dipped at a sufficient depth below the surface of liquid, which is 6 mm in a preferred embodiment of the invention and generally is preferably larger than 5 mm. For better detecting effect, the electrodes shall be kept at the same level in height.

Figure 4:
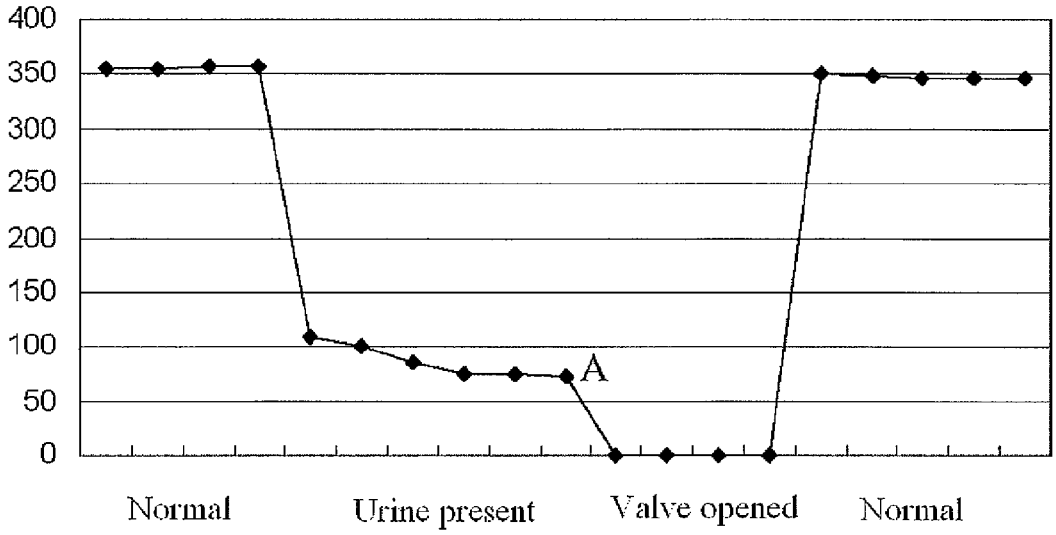
FIG. 4 is a schematic diagram illustrating an operative status of the conductivity sensor according to an embodiment of the invention.

FIG. 4 is a schematic diagram illustrating an operative status of the voltage sampled at the point A in FIG. 3 in practical use. It can be seen from the schematic diagram that:

Upon absence of urine, the voltage sampled at the point A is kept substantially at a reference value, i.e., the voltage sampled at the point A for pure tap water.

Upon inflow of urine, the conductivity sensor 2 detects a sharp drop of the voltage sampled at the point A, i.e., an increase of the conductivity. In an embodiment of the invention, a threshold value is preset so that the MCU determines presence of urine when the voltage sampled at the point A is below the threshold value.

When the voltage sampled at the point A keeps substantially unchanged and arrives at the equilibrium, the MCU determines the completion of pissing. Particularly, the completion of pissing can be determined with a three-point equilibrium method using the voltage sampled at the point A. That is, the voltage sampled at the point A can be determined to arrive at the equilibrium if its values detected at consecutive three points keep unchanged or substantially unchanged. The point A as illustrated represents an equilibrium value, and a variation between the value of the voltage sampled at the point A as detected at each of two preceding points to the point A, and that of the point A is smaller than a specific value. In a preferred embodiment of the invention, the three points can be determined to arrive at the equilibrium if no variation therebetween is larger than 5. Naturally, the specific value can be adjusted dependent upon the locations of the electrodes or the detection circumstance. In another embodiment of the invention, the three points can be determined to arrive at the equilibrium if no variation therebetween is larger than 10.

After determination of the equilibrium of the voltage sampled at the point A, the MCU controls the electromagnetic valve to be opened for rinsing. Particularly, rinsing can be delayed as needed. In a preferred embodiment of the invention, rinsing can be delayed by 6 to 10 seconds after determination of the equilibrium because it can be assumed that the user has gone away from the urinal after 6 to 10 seconds.

Following the foregoing descriptions, the amount of rinsing water can depend upon the concentration of urine. Naturally instead of the amount of rinsing water dependent upon the concentration of urine, the amount of rinsing water can be fixed in another preferred embodiment of the invention.

The conductivity sensor 2 detects that the voltage sampled at the point A goes back to the normal one at the end of rinsing.

As described above, the voltage sampled at the point A is used for detection and determination, but alternatively, the conductivity can be used for detection and determination. For example, a conductivity threshold value can be preset for determination of presence or absence of urine. Presence of urine can be determined when the conductivity is larger than the conductivity threshold value. For further determination of the equilibrium, a constant conductivity can be preset so that the equilibrium can be determined if a variation between the conductivities of urine sampled at N ($N \geqq 2$) consecutive points is smaller than the constant conductivity. Actually, the voltage sampled at the point A can reflect the conductivity. The voltage at the point A actually reflects the voltage between the electrodes. Of course, since the voltage sampled at the point A may present a value varying with a specific different circuit, the embodiment of the invention illustrated in FIG. 3 is just a preferred embodiment thereof. Therefore, any use of a value related to the conductivity for detection and determination shall be considered as the use of the conductivity for detection and determination and thus fall into the scope of the invention.

For a better implementation of low power consumption, a detection interval of time for the conductivity sensor in the status that urine is absent can differ from that in the status that urine is present. For example, the former can be larger than the latter. In a preferred embodiment of the invention, urine is detected at an interval of 5 seconds in the status that urine is absent and 1 second in the status that urine is present. In another preferred embodiment of the invention, urine is detected at an interval of 6 seconds in the status that urine is absent and 2 second in the status that urine is present.

The conductivity sensor 2 according to an embodiment of the invention is further arranged with a function of self-learning upon power-on or rinsing, so as to acquire the conductivity of pure tap water in the current circumstance. Thus, it is possible to obviate a problem that a uniform reference value of pure tap water is preset upon shipping from the factory but the conductivity of pure tap water may vary in a different region or period of time.

The conductivity sensor 2 according to an embodiment of the invention is arranged with two electrodes, but alternatively three electrodes can be used. Specifically, the conductivity sensor with three electrodes can determine the time of rinsing dependent upon the difference of concentrations of urine among the electrodes. When the voltage among the electrodes arrives at the equilibrium (that is, from the equilibrium in the status where urine is absent at the beginning, to the non-equilibrium in the status where urine is present and, further to the equilibrium after urine is distributed evenly), the conductivity sensor determines that the user has ceased pissing and further controls rinsing.

The urinal 100 according to an embodiment of the invention is arranged with a set of conductivity sensors. Plural sets of conductivity sensors can be arranged at different locations for more reliably detection.

Naturally, the conductivity sensor 2 according to an embodiment of the invention can also comprehensively determine whether to rinse by detecting the motion of a human body with another sensor, e.g., a microwave sensor, a pressure sensor, etc. Thus, a more ideal and reliable sensing effect can be achieved.

Although the embodiments of the invention have been disclosed as above, they are not intended to limit the scope of the invention, and modifications and variations of the embodiments made by those skilled in the art will also be encompassed in the scope of the invention.

What is claimed:

1. A conductivity sensor arranged in a bathroom appliance and comprising:

electrodes dipped into the bathroom appliance and adapted to detect the conductivity of solution, wherein the electrodes comprise positive and negative electrodes, and the conductivity sensor further comprises an anti-polarization-of electrode circuit comprising two sets of double throw switches adapted to toggle the polarities of the electrodes.

2. A urinal with a conductivity sensor, comprising the conductivity sensor arranged at a location where a reservoir of the urinal is curved and adapted to detect urine, a control unit (MCU), a power battery, and an electromagnetic valve adapted to control a discharge of water, wherein the conductivity sensor is adapted to detect a conductivity to determine whether urine is present; after the conductivity sensor detects presence of urine, the control unit opens the electromagnetic valve; the conductivity sensor comprises electrodes dipped inside the location where the reservoir is curved to contact urine; and the conductivity sensor further comprises an anti-polarization-of-electrode circuit comprising two sets of double throw switches adapted to toggle the polarities of the electrodes to achieve an alternating power supply.

3. The urinal with the conductivity sensor according to claim 2, wherein the electrodes comprise positive and negative electrodes.

4. The urinal with the conductivity sensor according to claim 2, wherein a detection frequency for the conductivity sensor in the status that urine is absent is lower than that in the status that urine is present.

5. The urinal with the conductivity sensor according to claim 2, wherein the conductivity sensor is capable of self-learning.

6. A urinal with a conductivity sensor, comprising the conductivity sensor arranged at a location where a reservoir of the urinal is curved and adapted to detect urine, a control unit (MCU), a power battery, and an electromagnetic valve adapted to control a discharge of water, wherein the conductivity sensor is adapted to detect a conductivity to determine whether urine is present; after the conductivity sensor detects presence of urine, the control unit opens the electromagnetic valve; the conductivity sensor comprises electrodes dipped inside the location where the reservoir is curved to contact urine; and the conductivity sensor further comprises an anti-polarization- of-electrode circuit;

wherein a conductivity threshold is preset so that presence of urine is determined when the conductivity is larger than the conductivity threshold and the concentration of urine is calculated from the conductivity and converted into the amount of rinsing water.

7. The urinal with the conductivity sensor according to claim 6, wherein a functional relationship between the concentration of urine and the conductivity is $A=aL^2+bL$, where A is the concentration of urine, L is the conductivity, and a and b are coefficients.

8. A urinal with a conductivity sensor, comprising the conductivity sensor arranged at a location where a reservoir of the urinal is curved and adapted to detect urine, a control unit (MCU), a power battery, and an electromagnetic valve adapted to control a discharge of water, wherein the conductivity sensor is adapted to detect a conductivity to determine whether urine is present; after the conductivity sensor detects presence of urine, the control unit opens the electromagnetic valve; the conductivity sensor comprises electrodes dipped inside the location where the reservoir is curved to contact urine; and the conductivity sensor further comprises an anti-polarization-of-electrode circuit;

wherein the conductivity sensor instructs the control unit to open the electromagnetic valve upon detection of the equilibrium of the conductivity of urine and a constant conductivity is preset so that the equilibrium is determined if variations among the conductivities of urine sampled at consecutive three points are smaller than the constant conductivity.

* * * * *